United States Patent [19]

Flewelling

[11] 4,257,410

[45] Mar. 24, 1981

[54] TRACTION DEVICE

[76] Inventor: Dale Flewelling, Moville, Iowa 51039

[21] Appl. No.: 108,648

[22] Filed: Dec. 31, 1979

[51] Int. Cl.[3] ..... A61H 1/02

[52] U.S. Cl. ..... 128/75; 128/84 C

[58] Field of Search ..... 128/75, 84 R, 84 C, 128/83

[56] References Cited

U.S. PATENT DOCUMENTS

| | | | |
|---|---|---|---|
| 2,186,036 | 1/1940 | Peachey | 128/84 C |
| 2,550,983 | 5/1951 | Ettinger | 128/75 |
| 2,638,091 | 5/1953 | Varco | 128/75 |
| 2,718,886 | 9/1955 | Sutton | 128/84 C |
| 3,063,445 | 11/1962 | Ries | 128/75 |
| 3,086,519 | 4/1963 | Pari | 128/75 |
| 3,826,490 | 7/1974 | Mossman | 128/84 C X |
| 3,856,003 | 12/1974 | Pfluger | 128/75 |
| 4,181,125 | 1/1980 | Carlson | 128/75 |

*Primary Examiner*—John D. Yasko

*Attorney, Agent, or Firm*—Roylance, Abrams, Berdo & Farley

[57] ABSTRACT

A traction device includes a pulley wheel and axle and a frame for adjustably supporting the axle including a U-shaped frame having a first central sleeve parallel with the side legs of the U, a horizontal support member slidably received in the first sleeve, a second sleeve at an end of the horizontal support for receiving a vertical support member having the pulley at the top. L-shaped braces pass through the ends of the side legs to form clamping members with the side legs. Square tubular members of two sizes are used to form the frame.

6 Claims, 9 Drawing Figures

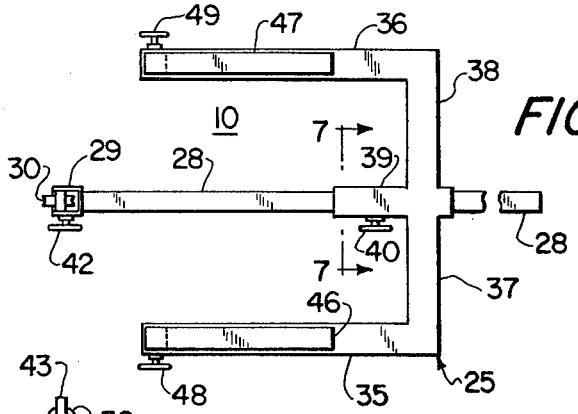
FIG. 4
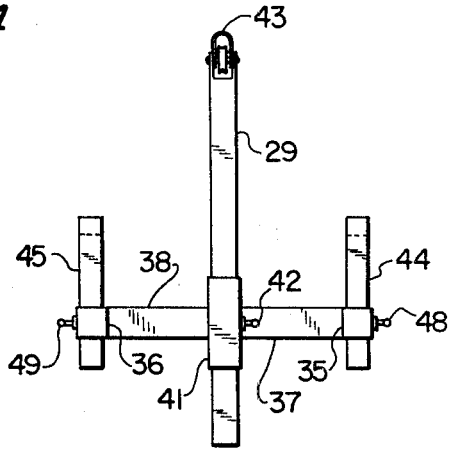
FIG. 6
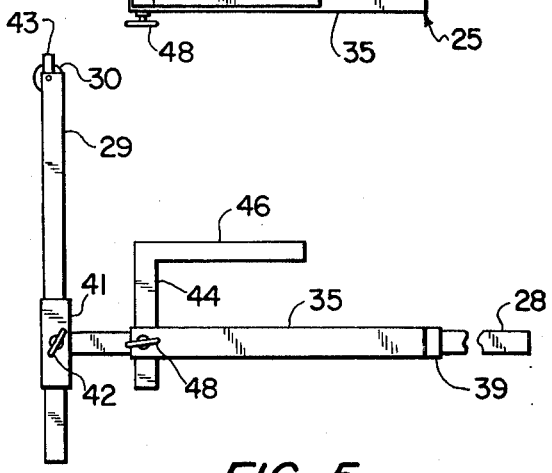
FIG. 5
FIG. 7
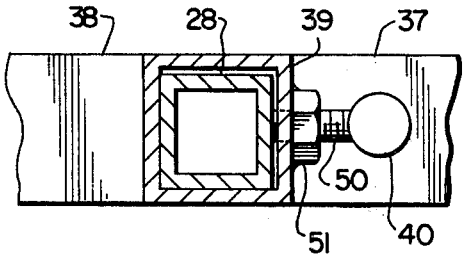
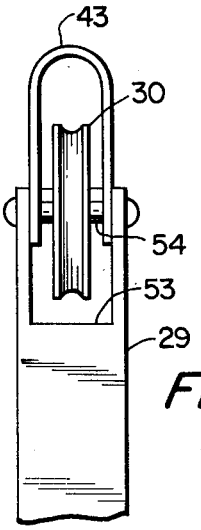
FIG. 8
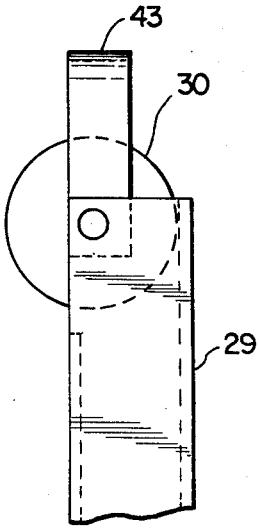
FIG. 9

TRACTION DEVICE

This invention relates to an improved traction device and particularly to a device attachable to operating and conveying tables for applying weight traction before, during and after surgical procedures in a hospital environment.

BACKGROUND OF THE INVENTION

Various devices have been developed and used for applying a drawing or pulling force to portions of the body, usually using weights. The application of such force, referred to as traction, is variously used as a corrective or therapeutic measure, and is also used in fracture cases to keep the end of bone at the fracture point in the desired place. Traction can take several forms including skeletal and skin traction in which the force is applied through pins, wires, tape or other fasteners placed on or through the body part. In head traction, pull is exerted on the head to relieve pressure and deformity in cases of neck injury.

In a hospital environment it is very important to be able to apply force at a specific desired angle, and the force must be adjustable over a rather wide range. Furthermore, the device used to apply the traction must be attachable to a variety of patient support structures including operating tables, patient conveying tables such as stretcher beds, and hospital beds; and must be quiet strong.

Traction devices for weight traction are all broadly similar in that they constitute structures for supporting the rotation axis of a pulley over which a rope or cord is passed between the selected portion of the patient's body and a weight with the weight hanging relatively freely. Examples of prior art devices are found in the following U.S. Patents:

U.S. Pat. No. 3,856,003; Pfluger
U.S. Pat. No. 3,826,490; Mossman
U.S. Pat. No. 3,086,519; Pari
U.S. Pat. No. 3,063,445; Ries
U.S. Pat. No. 2,638,091; Varco
U.S. Pat. No. 2,550,983; Ettinger
U.S. Pat. No. 2,186,036; Peachey While each of these devices appears to be usable in a specific set of circumstances, none meets the requirements of strength, adaptability to a variety of support bodies and a wide range of angles over which traction force can be applied.

BRIEF DESCRIPTION OF THE INVENTION

Accordingly, it is an object of the present invention to provide a traction pulley support attachable to a variety of patient support devices.

A further object is to provide such a traction pulley support in which the effective angle of force can be adjusted over a wide range including angles below the horizontal and about 45° above the horizontal.

Another object is to provide a traction support which is easily adjustable and is movable from one patient support device to another.

A still further object is to provide an improved traction pulley support structure which is simple, can be easily and economically manufactured, and is sturdy and reliable in use.

Briefly described, the invention comprises an improved traction device for use with a patient support apparatus, the device being of the type having a rotatable pulley adapted to receive and support a flexible line extending between the body of a patient and a weight, an axle rotatably supporting the pulley and a support structure for said axle, the improvement wherein said support structure includes a generally U-shaped substantially rigid frame having two side legs and an interconnecting portion lying in a plane which, in use, is generally horizontal; a first hollow, elongated sleeve attached to said interconnecting portion and extending generally parallel with said side legs, an elongated horizontal support member slidably received in said first sleeve, the length of said horizontal support member being greater than said side legs, a second hollow elongated sleeve attached to said horizontal support member and extending perpendicular to the plane containing said frame, an elongated vertical support member slidably received in said second sleeve, means at the upper end of said vertical support member for holding said axle; first and second generally L-shaped brace members; means near the distal end of each of said side legs defining an opening for receiving a leg of one of said brace members with the other leg thereof extending parallel with its associated side leg toward said interconnecting portion; and means on said first and second sleeves for selectively restraining said horizontal and vertical support members, respectively, against longitudinal motion through said sleeves.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein:

FIG. 4 is a top plan view of the traction device of FIG. 3;

FIG. 5 is a side elevational view of the device of FIGS. 3 and 4;

FIG. 6 is an end elevation of the device of FIGS. 3–5;

FIG. 7 is a partial end elevation, in partial section, along line 7—7 of FIG. 4; and FIGS. 8 and 9 are partial end and side elevational views, respectively, of the upper end of the vertical support member of the device of FIGS. 3–6 showing the pulley assembly thereon.

DETAILED DESCRIPTION OF THE DRAWINGS

Figure 1:
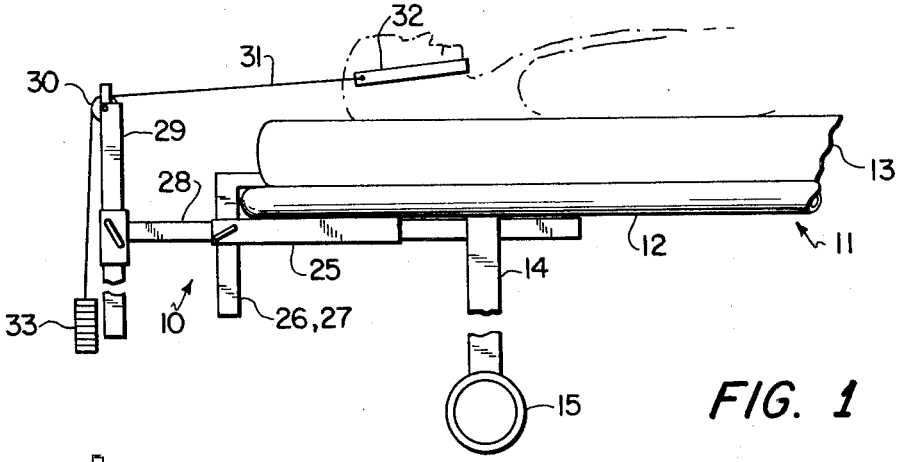
FIG. 1 is a schematic partial side elevation of a patient transporting apparatus with a traction device in accordance with the invention mounted thereon.
Figure 2:
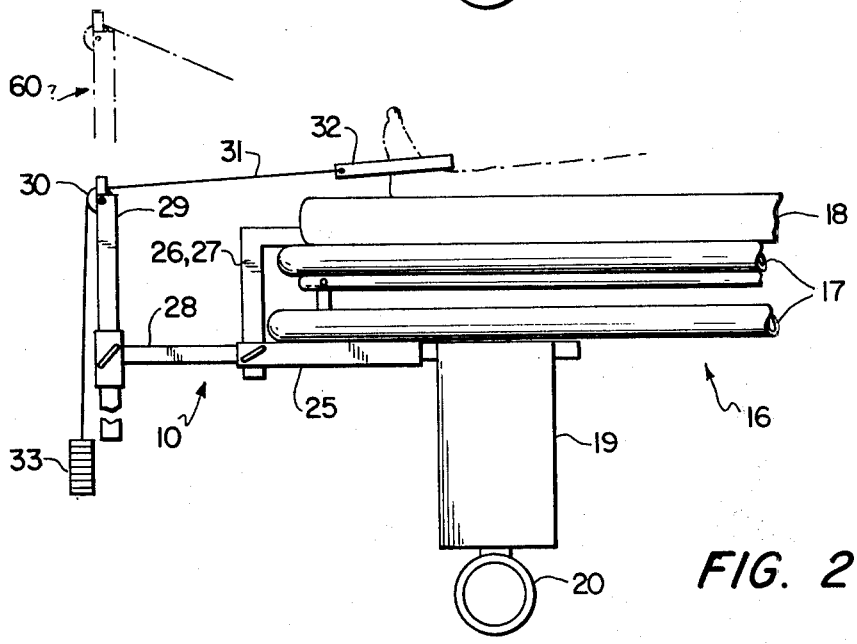
FIG. 2 is a schematic partial side elevation of an operating table with a traction device in accordance with the invention mounted thereon.
Figure 3:
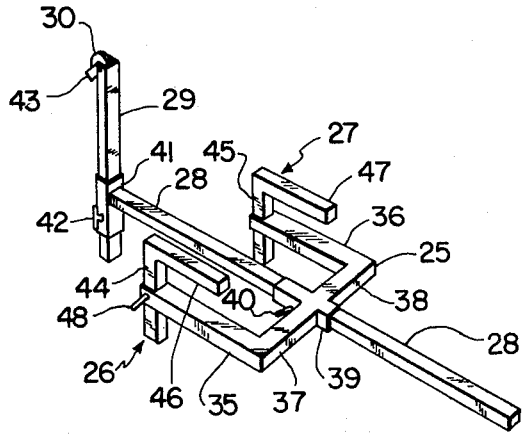
FIG. 3 is a perspective view of a traction device in accordance with the invention.

FIGS. 1 and 2 are included primarily to illustrate two typical situations in which the apparatus of the invention can be used and to illustrate also the general manner of use. As seen in FIG. 1, the traction device indicated generally at 10 can be mounted on a patient conveying device such as a stretcher cart indicated generally at 11 which has a relatively simple frame 12, a mattress 13 for supporting a patient and a support structure 14 having wheels 15. This type of device is conventionally used for transporting patients within a hospital, and it is often the case that the patient must be maintained under traction during this transportation.

In FIG. 2, the traction device 10 is shown mounted on a typical operating table indicated generally at 16 which has a somewhat more complex and vertically thicker frame structure 17 and may or may not also have a mattress or pad 18 for supporting the patient. The operating table also has a support structure 19 which is often provided with wheels 20, thereby rendering the operating table moveable. However, the operating table itself is seldom used for patient transportation because of its specialized nature and its size and weight.

The traction device will be described in detail in connection with FIGS. 3–9, but it will be observed in FIGS. 1 and 2 that the structure includes a frame portion 25 which extends below the bottom portion of either frame 12 or frame 17 and brace members 26 and 27 which pass through portions of frame 25, legs of the brace members extending horizontally, in parallel relationship with the frame, so as to encompass and engage the upper portion of the frame, normally below the mattress 13 or 18. The apparatus also includes a horizontal support member 28 which carries a vertical support member 29 having a pulley 30 at the upper end thereof. A flexible line 31 extends between a device 32 attached to a portion of the patient's body and a weight 33 which, in the usual fashion, supplies the force.

It will be recognized that the beds themselves and the devices for attachment to the body form no part of the present invention and are conventional, and will therefore not be described in any further detail. It is important only to note that the device of the present invention is adaptable not only to a variety of patient support devices similar to those shown, but also to any form of bed or the like having a horizontal structure for receiving a patient. It will also be recognized that a hospital bed having portion capable of inclined adjustment can receive the traction device and that a variety of angular relationships can be established in that use.

Turning now to the remaining figures for discussion of the apparatus in detail, it will be seen in FIGS. 3–6 that the frame 25 includes first and second side legs 35 and 36 and a transverse interconnecting portion formed of two relatively short cross-pieces 37 and 38 which are connected to a sleeve 39. Members 35–39 are, preferably, all formed and assembled using tubular material of square cross-section and are joined by any suitable attachment technique although welding is preferred. Thus, members 37 and 38 can be welded to the outer sides of sleeve 39, leaving the interior of the sleeve open and hollow. These members can be made using tubing which is one inch (2.54 cm.) wide on each side with a wall thickness of approximately $\frac{1}{8}$ inch (3.175 mm.). A clamping or locking device is provided in a side of sleeve 39, the device having a handle 40 which can be used to tighten the locking device.

The horizontal support member 28 is an elongated tubular member, also of square cross-section and being approximately $\frac{3}{4}$ inches (1.9 cm.) on a side so that it can be received in sleeve 39 in sliding relationship. Handle 40 can be used to tighten the locking device against a side of member 28 to restrain it against longitudinal movement when the support member is in the desired position.

Members 35–38 form a generally U-shaped framework which opens away from the end of the bed, in use. At the end of support member 28 toward which that U opens, member 28 is fixedly attached to a generally vertically extending sleeve 41 which is similar in nature to sleeve 39 and is formed from the larger (1 inch) hollow tubing. Sleeve 41 is also supplied with a locking device having a handle 42. Vertical support member 29, made of the same size tubing as member 28, extends through sleeve 41 and has, at its upper end, pulley 30 and a bail 43.

At the distal end of each of legs 35 and 36 of frame 25 is a vertical square opening to receive one leg of one of the brace members, brace member 26 having a leg 44 which extends through the opening in leg 35 and brace 27 having a leg 45 which extends through the opening in leg 36. Braces 26 and 27 are L-shaped, having legs 46 and 47, respectively, extending above and in parallel relationship with their associated slide legs 35 and 36. Thus, legs 35 and 46 and legs 36 and 47 form clamping devices which can be adjusted to engage a bed frame or similar structure of a variety of thicknesses limited only by the lengths of legs 44 and 45.

Legs 35 and 36 are also provided with locking devices having handles 48 and 49 which can be tightened to hold legs 44 and 45, respectively, in the desired positions.

The details of a locking device are shown in FIG. 7. Since all of the locking devices employed are of substantially the same configuration, only one will be shown and described in great detail, that being the one supplied in sleeve 39 to restrain horizontal support member 28 against longitudinal movement therein when it has been placed in its desired position. The handle 40 of the locking device is fixedly attached to an externally threaded rod 50 which passes through an internally threaded body 51, such as a conventional nut, which is welded or otherwise fixedly attached to the outside side surface of sleeve 39. The side of sleeve 39 has a hole therethrough coaxially aligned with the threaded opening through nut 51 through which shaft 50 can pass. Thus, when sleeve 28 is properly disposed therein, clockwise rotation of handle 40 causes the shaft to protrude to the interior of sleeve 39, frictionally engaging the side of member 28 and restraining it against longitudinal movement.

FIGS. 8 and 9 show, in more detail, the upper end of vertical support member 29 which carries the pulley 30. One side of the square tube forming support member 29 is cut away, forming a notch 53 through which the side of the pulley can extend. An axle 54 is fixedly mounted in the upper end of member 29 and supports both the pulley and bail 43. The pulley 30 is, of course, rotatably mounted on axle 54 or, alternatively, the axle can, itself, be rotatably mounted.

As will be recognized from FIGS. 1 and 2, considered in conjunction with the other figures, horizontal support member 28 and vertical support member 29 can be adjusted to dispose pulley 30 in a wide variety of positions relative to the surface on which the patient is supported, the extent of the adjustment in an upward and outward direction being limited only by the chosen lengths of the square tubing used to construct members 28 and 29. A particular advantage of the structure is that the upper portion of pulley 30, over which line 31 passes, can be positioned so that the direction of traction force applied to the body portion of the patient can form an angle with the horizontal which is downward and away from the patient and also upward, if desired. The application of force and the chosen direction depends upon the condition being treated and it is extremely important to be able to apply the force in an angle determined only by that condition and not limited by the structure of the traction device itself. With a suitable length for member 29, the elevation of pulley 30, and the angle of traction force, can be raised to, for example, on the order of 45° above the horizontal as illustrated at 60 in phantom lines in FIG. 2.

While one advantageous embodiment has been chosen to illustrate the invention, it will be understood by those skilled in the art that various changes and modifications can be made therein without departing from the scope of the invention as defined in the appended claims.

What is claimed is:

1. An improved traction device for use with a patient support apparatus, the device being of the type having a rotatable pulley adapted to receive and support a flexible line extending between the body of a patient and a weight, an axle rotatably supporting the pulley and a support structure for said axle, the movement wherein said support structure includes a generally U-shaped, substantially rigid frame having two side legs and an interconnecting portion lying in a plane which, in use, is generally horizontal;

a first hollow, elongated sleeve attached to said interconnecting portion and extending generally parallel with said side legs;

an elongated, horizontal support member slidably received in said first sleeve, the length of said horizontal support member being greater than said side legs;

a second hollow elongated sleeve attached to said horizontal support member and extending perpendicular to the plane containing said frame;

an elongated vertical support member slidably received in said second sleeve;

means at the upper end of said vertical support member for holding said axle;

first and second generally L-shaped brace members;

means near the distal end of each of said side legs defining an opening for receiving a leg of one of said brace members with the other leg thereof extending parallel with its associated side leg toward said interconnecting portion; and means on said first and second sleeves for selectively restraining said horizontal and vertical support members, respectively, against longitudinal motion through said sleeves.

2. A device according to claim 1 wherein said side legs of said frame and said first and second sleeves are hollow, rectangular in cross-section and of the same inner and outer cross-sectional dimensions, and said horizontal and vertical support members and said first and second brace members are rectangular in cross-section, the outer dimensions thereof being smaller than the inner cross-sectional dimensions of said side legs and sleeves.

3. A device according to claim 2 wherein said side legs, sleeves, support members and brace members are square in cross-section.

4. A device according to claim 1 wherein each of said means for restraining includes means defining a hole through a side of a sleeve;

an internally threaded body fixedly attached to a side of said sleeve coaxially with said hole;

an externally threaded shaft matingly received in said body with one end extending toward the interior of said sleeve; and a handle attached to the other end of said shaft, whereby rotation of said handle in one direction causes said shaft to advance into said sleeve to contact the support member received therein.

5. A device according to claim 1 and further including means in said side legs adjacent said openings for selectively restraining said brace members against sliding movement therethrough.

6. A device according to claim 5 wherein each of said means for restraining includes means defining a hole through a side of each of said sleeves and each of said side legs adjacent said openings;

an internally threaded body fixedly attached in coaxial relationship with each said hole;

an externally threaded shaft matingly received in said body with one end extending into said hole; and a handle attached to the other end of said shaft.

* * * * *